US007082277B2

(12) United States Patent
Nagatomo et al.

(10) Patent No.: US 7,082,277 B2
(45) Date of Patent: Jul. 25, 2006

(54) CONTACT CHARGER AND IMAGE FORMING APPARATUS

(75) Inventors: Yuji Nagatomo, Amagasaki (JP); Makiko Tango, Uji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 62 days.

(21) Appl. No.: 10/791,801

(22) Filed: Mar. 4, 2004

(65) Prior Publication Data

US 2005/0129428 A1 Jun. 16, 2005

(30) Foreign Application Priority Data

Dec. 10, 2003 (JP) ..... 2003-411934

(51) Int. Cl.
*G03G 15/02* (2006.01)

(52) U.S. Cl. ..... 399/175; 399/174

(58) Field of Classification Search ..... 399/175, 399/174, 176

See application file for complete search history.

(56) References Cited

U.S. PATENT DOCUMENTS

| | | | | |
|---|---|---|---|---|
| 4,099,186 | A * | 7/1978 | Edwards et al. | 346/74.7 |
| 5,225,878 | A * | 7/1993 | Asano et al. | 399/167 |
| 5,241,342 | A * | 8/1993 | Asano et al. | 399/175 |
| 5,289,234 | A * | 2/1994 | Asano et al. | 399/113 |
| 5,305,061 | A * | 4/1994 | Takama et al. | 399/167 |
| 5,455,661 | A * | 10/1995 | Yoshida et al. | 399/175 |
| 5,652,649 | A * | 7/1997 | Ikegawa et al. | 399/175 |
| 5,731,119 | A * | 3/1998 | Eichorst et al. | 430/63 |
| 6,081,681 | A * | 6/2000 | Nagase et al. | 399/174 |
| 6,124,066 | A * | 9/2000 | Kim et al. | 430/111.32 |
| 6,130,017 | A * | 10/2000 | Hayashi et al. | 430/108.3 |
| 6,233,419 | B1 | 5/2001 | Chigono et al. | |
| 6,596,452 | B1 * | 7/2003 | Magome et al. | 430/106.2 |
| 6,677,093 | B1 * | 1/2004 | Yoshino et al. | 430/106.2 |
| 6,728,504 | B1 * | 4/2004 | Ariizumi et al. | 399/267 |
| 2005/0069345 | A1 * | 3/2005 | Nagatomo et al. | 399/175 |

FOREIGN PATENT DOCUMENTS

| | | |
|---|---|---|
| JP | 09-175821 | 7/1997 |
| JP | 10-307457 | 11/1998 |
| JP | 10-307458 | 11/1998 |
| JP | 11-190930 | 7/1999 |

* cited by examiner

*Primary Examiner*—Diego Gutierrez
*Assistant Examiner*—Amy R. Cohen
(74) *Attorney, Agent, or Firm*—Buchanan Ingersoll PC

(57) ABSTRACT

A contact charger for charging a charging target (e.g., a photosensitive member) includes a charging brush to be in contact with the charging target, and auxiliary charging particles to be interposed between the brush and the charging target. The auxiliary charging particle takes an acicular form having an aspect ratio from 2 to 10000, and satisfies a relationship of ($L^2/T \leqq 200$) between a length L (μm) of a long axis of the particle and a thickness of T (deniers) of a brush fiber of the brush.

19 Claims, 1 Drawing Sheet

CONTACT CHARGER AND IMAGE FORMING APPARATUS

CROSS-REFERENCE TO RELATED APPLICATION

This application is based on Japanese patent application No. 2003-411934 filed in Japan on Dec. 10, 2003, the entire content of which is hereby incorporated by reference.

BACKGROUND OF THE INVENTION

1. Field of the Invention

The present invention relates to a contact charger for use in an electrophotographic image forming apparatus such as a copying machine or a printer, and also relates to an image forming apparatus provided with such a contact charger.

2. Description of Related Art

<Corona Charger>

Conventional image forming apparatuses such as an electrophotographic device have employed corona chargers, which utilize corona discharging for charging a charging target (i.e., an object to be charged) such as a photosensitive member for electrophotography.

The corona charger is arranged in a noncontact manner with respect to the charging target, and is configured such that a high voltage is applied, e.g., to a wire electrode or a needle electrode for causing corona discharging, and thereby a part of discharge current thus caused flows through the charging target to place a predetermined potential on the charging target.

However, the corona charger utilizing the corona discharging generates a large amount of ozone, which causes a problem due to ozone smell or the like. Also, a discharging product produced by the corona discharging adheres to a surface of the charging target. Thereby, quality of images is impaired, and/or the surface of the charging target has to be shaved for recovery from deterioration due to the adhesive discharging product.

This causes problems such as reduction of durability of the charging target. Further, a power source of a high voltage and therefore an expensive power source are required.

<Contact Charger (Charging by Discharging)>

In recent years, therefore, many contact chargers have been proposed for use instead of the corona chargers. For example, a roller charger, a fur-brush charger, a blade charger and others have been proposed. These charges are configured to charge the charging target by utilizing a discharging phenomenon, which occurs between the charging target and the charging member. The charging member is arranged in direct contact with the charging target, and a voltage is applied to the charging member to place a predetermined potential on the charging target.

The roller charger includes an elastic roller having, e.g., an electrically conductive elastic layer. The elastic roller is in contact with the charging target to form a nip, and a voltage is applied to the elastic roller to charge the charging target. In many structures, the elastic roller is driven to rotate by the charging target.

The fur-brush charger is formed of a fur-brush roller, e.g., having electrically conductive brush fibers. The fur-brush roller is in contact with the charging target to form a nip, and a voltage is applied to the fur brush to charge the charging target.

Since the fibers used therein are extremely thin, a strong electric field is locally produced between the fur brush and the charging target, and excessive discharging not following Paschen's law occurs in the strong electric field so that irregular charging occurs.

Since the contact between the charging target and the brush fibers consists of a gathering or combination of line-contacts and/or point-contacts, it is difficult to ensure a sufficiently large contact area between the charging target and the fur brush so that it is impossible to prevent insufficient charging due to insufficient contact.

These contact chargers can charge the target with power sources of lower voltages than those of the corona charger. In these contact chargers, however, a voltage prepared by adding a threshold voltage to an intended charging potential for following Paschen's law must be applied to the charging member. Further, the amount of produced ozone can be smaller than that of the corona charger, but disadvantages due to the discharging product are unavoidable because the charging operation utilizes the discharging phenomenon.

<Contact Charger (Injection Charging)>

For overcoming the above problems, such a contact charger has been proposed that injects electric charges directly into a charging target without utilizing the discharging phenomenon. For example, a magnetic brush charger, a roller charger, a fur-brush charger and others have been proposed as the contact chargers utilizing injection charging.

These chargers are configured to charge the charging target to bear a voltage substantially equal to the voltage applied to the charging member, and therefore can utilize a voltage lower than that of the foregoing contact charger utilizing the discharging phenomenon. Further, the discharging does not occur or is sufficiently suppressed so that the discharging product hardly occurs, and disadvantages due to the discharging product do not occur.

The magnetic brush charger is formed of, e.g., a nonmagnetic sleeve covering a magnetic roller and magnetic carriers retained on the sleeve, which hold electrically conductive particles. Spikes (magnetic brush) formed of the carriers holding the conductive particles are in contact with the charging target to form a nip, and a voltage is applied to the magnetic brush to charge the charging target by charge injection. This type of charger requires a complicated structure, and therefore is expensive. Further, it suffers from dropping of the magnetic carriers as well as image noises due to adhesion of the magnetic carriers onto the charging target such as a photosensitive member.

According to the roller charger, the conductive and elastic roller is brought into contact with the charging target to form a nip, and a voltage is applied to the elastic roller to effect injection charging on the charging target. For effecting the injection charging on the charging target, a sufficient contact area is required between the roller surface and the charging target.

However, such a sufficient contact area cannot be achieved if the elastic roller is merely driven to rotate by the charging target. For obtaining the sufficient contact area, a difference may be provided between peripheral speeds of the elastic roller and the charging target so that the elastic roller may slide on the charging target. However, this causes a large frictional force because the elastic roller is in face-contact with the charging target. Thereby, the surfaces of the charging member and the charging target may be unnecessarily shaved to generate image noises. Also, the durability thereof may be reduced.

For reducing the frictional force, Japanese Laid-Open Patent Publication No. H10-307458 has disclosed a roller charger, in which conductive particles are disposed in a contact nip between the roller charger and the charging target.

Even in this structure, a frictional force is larger than that in the chargers, which utilize line-contact and/or point-contact of a fur-brush or a magnetic brush, and therefore, the charging member and the charging target are shaved so that image noises occur, and low durability is unavoidable.

For example, Japanese Laid-Open Patent Publication No. H10-307457 has disclosed a fur-brush charger, in which a fur brush is in contact with the charging target to form a nip, conductive particles are present in this nip portion at a rate of $10^2$ pcs/mm$^2$ or more, and a voltage is applied to the fur brush to perform injection charging on the charging target.

Since the fur brush is in line-contact and/or a point-contact with the charging target, a frictional force between them is small, and wearing of the charging member and the charging target is considerably suppressed. Further, the discharging phenomenon is not utilized so that irregular charging due to excessive discharging can be prevented.

Since the conductive particles are present between the charging target and the fur brush, insufficient contact between the fur brush and the charging target can be suppressed, as compared with the fur brush charging utilizing the discharging phenomenon already described.

However, the fur brush injection charging device, in which the conductive particles are present in the contact nip portion between the fur brush and the charging target, suffers from a problem that stable charging cannot be sufficiently performed because the conductive particles drop from the fur brush.

In connection with the above problem, Japanese Laid-Open Patent Publication No. H11-190930 has disclosed a technique, in which conductive particles are mixed into developer to be supplied. Also, U.S. Pat. No. 6,233,419 has disclosed a technique, in which a conductive particle supply member such as an elastic foam roller or a fur brush is used for supplying conductive particles.

However, it is difficult to utilize sufficiently the technique, in which the conductive particles are mixed into the developer as disclosed in Japanese Laid-Open Patent Publication No. H11-190930, because the chargeability of the toner may lower depending on the mixing rate of the conductive particles into the developer and/or depending on the particle diameter of the conductive particles. If the supply member is used for supplying the conductive particles, as disclosed in U.S. Pat. No. 6,233,419, the supply member increases a cost.

SUMMARY OF THE INVENTION

An object of the invention is to provide a contact charger, which has a simple structure, and can perform uniform and stable charging for a long term.

Another object of the invention is to provide an inexpensive contact charger, which can charge a charging target with a low voltage and without generating ozone.

Still another object of the invention is to provide an electrophotographic image forming apparatus using a contact charger for charging a photosensitive member, and particularly to provide an image forming apparatus, which can stably and uniformly charge the photosensitive member for a long term, and thereby can form good images for a long term while suppressing image noises.

The invention provides a contact charger including at least a charging brush having brush fibers for charging and auxiliary charging particles, which have acicular (needle-shaped) forms.

The charging brush is to be in contact with a charging target, and the auxiliary charging particles are interposed between the brush and the charging target for charging the charging target.

Also, the invention provides an image forming apparatus for forming an image in an electrophotographic manner, including the above contact charger, a photosensitive member serving as a charging target to be charged by the contact charger, an exposing device performing image exposure on the photosensitive member to form an electrostatic latent image, and a developing device developing the electrostatic latent image on the photosensitive member.

The brush of the contact charger may be typically a fur brush.

In any case, since the brush of the charger make line-contact and/or point-contact with the charging target, a frictional force between the brush and the charging target is small, and an amount of wearing of the brush and the charging target, which may be caused by charging operation, can be sufficiently reduced. Therefore, it is possible to increase the durability of the charger and the charging target.

Since the charger does not utilize a discharging phenomenon, it is possible to prevent irregular charging due to excessive discharging.

Although the brush described above makes the line-contact and/or point-contact with the charging target, the auxiliary charging particles are present between the charging target and the brush so that a sufficiently large contact area can be ensured between the brush and the charging target (more strictly, it is possible to achieve an effect equivalent to ensuring of a sufficiently large contact area between the brush and the charging target). Therefore, the intended injection charging can be performed.

Further, the auxiliary charging particle has the acicular form, and in other words, has such a form that a length or longer size of the particle in its longitudinal direction is larger than a diameter of a cross section of the particle perpendicular to the longitudinal direction. Therefore, the particle can be in contact with the brush fiber through a wider contact area than an auxiliary charging particle of a spherical form, which can be merely in point-contact with the brush fiber, and at least, it is possible to increase a possibility of occurrence of line-contact between the particles and the brush fibers, and thus to increase the contact area. This increases a Van der Waals force and a liquid cross-link force between the auxiliary charging particles and the brush fibers so that it is possible to provide a large adhesion force between the auxiliary charging particles and the brush fibers, and thus to perform stably the intended injection charging for a long term.

Owing to the above, the contact charger according to the invention can stably and uniformly charge the charging target for a long term by a simple structure.

Further, the charging can be performed at a lost cost with a low voltage and without generating ozone.

According to the image forming apparatus of the invention employing the above charger, it is possible to charge stably and uniformly the surface of the photosensitive member for a long term so that it is possible to form good images for a long term while suppressing image noises.

The foregoing and other objects, features, aspects and advantages of the present invention will become more apparent from the following detailed description and the accompanying drawings.

DESCRIPTION OF THE PREFERRED EMBODIMENTS

Figure 1:
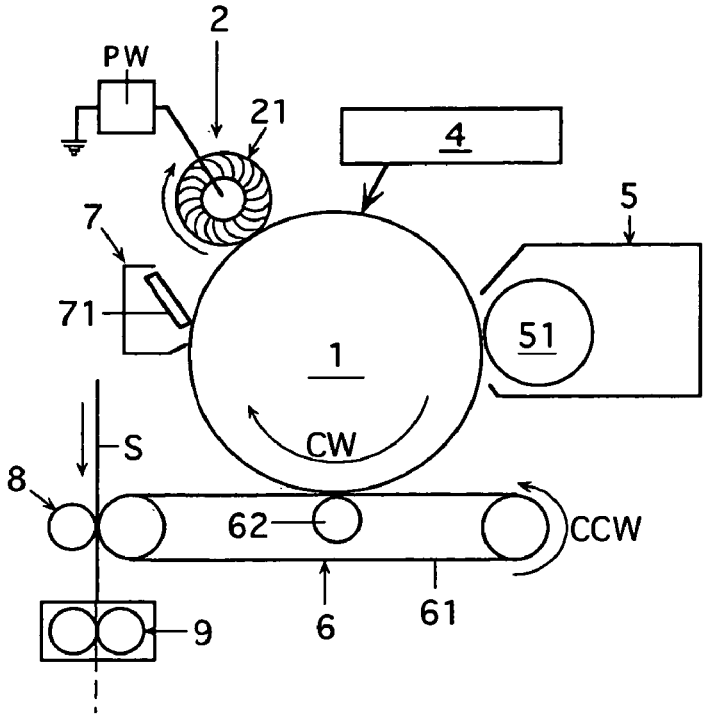
FIG. 1 schematically shows a structure of an example of an image forming apparatus according to the invention.

Embodiments of the invention will now be described. FIG. 1 schematically shows a structure of an example of an electrophotographic image forming apparatus provided with a contact charger 2 according to an embodiment of the invention.

<Image Forming Apparatus>

An image forming apparatus shown in FIG. 1 includes a photosensitive member 1 of a drum type, and also includes the charger 2, an image exposing device 4, a developing device 5, an intermediate transfer device 6 and a cleaning device 7, which are arranged in this order around the photosensitive member 1. A secondary transfer roller 8 is opposed to the intermediate transfer device 6.

The image forming apparatus further includes a fixing roller pair 9. The developing device 5 is provided with a developing roller 51 and others. The intermediate transfer device 6 is provided with an endless transfer belt 61 opposed to the photosensitive member 1 and a transfer roller 62 opposed to the photosensitive member 1 with the belt 61 therebetween. The cleaning device 7 includes a cleaning blade 71, which is in contact with the photosensitive member 1, and others.

According to this image forming apparatus, a drive unit (not shown) drives the photosensitive member 1 in a direction CW shown in FIG. 1, and the contact charger 2 uniformly charges the surface of the photosensitive member 1. The exposing device 4 effects image exposure corresponding to original images or image data on a charged region of the surface of the photosensitive member 1 so that an electrostatic latent image is formed on the photosensitive member 1.

The developing roller 51 of the developing device 5 supplied with a developing bias develops this electrostatic latent image so that a visible toner image is formed. In the intermediate transfer device 6, the intermediate transfer belt 61 is driven by a drive unit (not shown) to rotate in a direction CCW shown in FIG. 1, and a transfer voltage is applied to the transfer roller 62.

The toner image on the photosensitive member 1, which reaches the transfer belt 61, is transferred onto the transfer belt 61 by the transfer roller 62 carrying the transfer voltage. In synchronization with the toner image on the transfer belt 61, a record medium S supplied from a record medium supply portion (not shown) is supplied to a position between the transfer belt 61 and the secondary transfer roller 8, and the secondary transfer roller 8 carrying the transfer voltage transfers the toner image from the transfer belt 61 onto the recording medium S. The recording medium bearing the toner image thus transferred is sent to the fixing roller pair 9, which fixes the toner image by pressure and heat, and then is discharged onto a tray (not shown).

<Charger>

The charger 2 is of a contact type, and basically has a fur brush 21 serving as a contact charging member to be in contact with the photosensitive member 1, i.e., the charging target, and auxiliary charging particles 3 are interposed between the fur brush 21 and the photosensitive member 1 for charging the photosensitive member 1. In this example, the photosensitive member 1 is charged by moving the fur brush 21 relatively to the photosensitive member 1.

Figure 2:
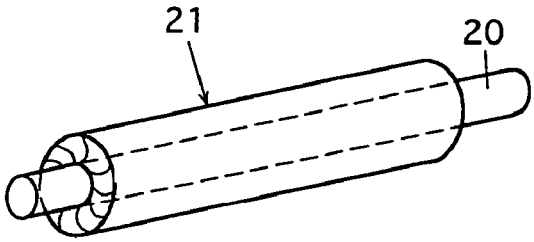
FIG. 2 is a perspective view schematically showing a brush of the contact charger shown in FIG. 1.
Figure 3:
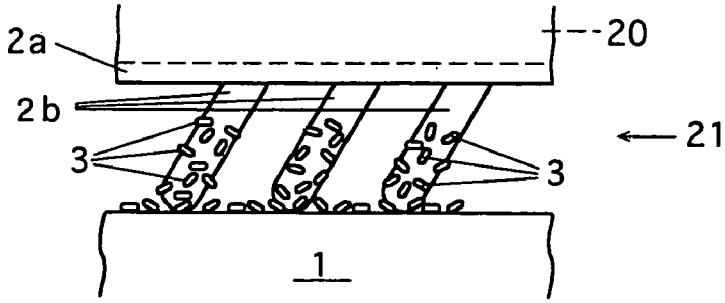
FIG. 3 schematically shows, on an enlarged scale, a portion of the contact charger brush shown in FIG. 2.

FIG. 2 is a perspective view schematically showing the brush 21 of the contact charger 2, and FIG. 3 schematically shows, on an enlarged scale, a portion of the contact charger brush 21.

The charger 2 includes the fur brush 21 of the roller type, in which brush fibers **2*b* are set on a base fabric 2*a*, and the base fabric 2*a* is adhered by double-faced adhesive tape to a surface of a cylindrical core roller 20. A rear surface of the base fabric is covered with electrically conductive coating or paint, and thus is electrically conductive. The double-faced adhesive tape is partially removed so that a part of the base fabric is in direct contact with the core roller 20 to achieve electrical conductivity between the fur brush 21 and the core roller 20. The fur brush 21 is supplied with a predetermined charging voltage from a power source PW via the core roller 20**, and is driven to rotate by a drive unit (not shown).

The brush fibers **2*b*** may be formed of general fibers, over which electrically conductive materials are distributed. Such fibers may be made of, e.g., polyamide (nylon), polyvinyl alcohol (vinylon), acrylic resin, polyester or viscose rayon.

The conductive materials may be metal such as aluminum, iron, copper or nickel, electrically conductive oxide such as zinc oxide, tin oxide or titanium oxide, or carbon particles made of, e.g., carbon black, graphite or carbon nanotube.

The brush fibers **2*b*** may be made of electrically conductive polyamide (conductive nylon) such as UUN, GBN or SUN, electrically conductive vinylon such as USV or electrically conductive viscose rayon such as REC, all of which are manufactured by Unitika Ltd.

The charger 2 may have a fixed type brush, in which the brush fibers **2*b*** are set on the base fabric, and the base fabric is adhered to a metal sheet or the like by adhesive or the like.

The fur brush may be selected from known two types, i.e., a straight hair type and an inclined hair type requiring a step of inclining the brush fibers in a manufacturing process.

According to the inclined hair type, the brush fibers are inclined with respect to the charging target so that a large contact area can be easily ensured on the charging target, and therefore a region used for injecting the charges increases. Therefore, the charging can be performed further uniformly.

In view of this, the inclined hair type is more advantageous. It is advantageous that the brush roller rotates in such a direction that the rotating charging target smoothly strokes the brush fibers because the rotation in the reverse direction disturbs and partially removes the brush fibers to cause a failure in charging.

In the manufacturing process, it is desired that the fur brush roller 21 is processed to incline the brush fibers such that free ends thereof are shifted upstream in the rotating direction of the fur brush roller with respect to the base ends of the brush fibers.

If there is a failure such as a pin-hole in the photosensitive member 1, i.e., the charging target, an excessive current flows from the brush to such a faulty portion to cause faulty charging in the direction of the brush axis. Also, the brush fibers, through which the excessive current flows, may cause faulty charging in the brush rotating direction, and/or the excessive current may partially deteriorate the brush fibers and the faulty portion of the photosensitive member 1.

For preventing these problems, it is desired that brush fibers having a volume resistivity (specific volume resistance) not lower than $1\times10^1$ Ω·cm are employed regardless of the forging types and structures. For passing a sufficient charging current required for the charging, it is preferable that the brush fibers have a volume resistivity not exceeding $1\times10^8$ Ω·cm. It is further preferable that the brush fibers have a volume resistivity from $1\times10^2$ Ω·cm to $1.2\times10^5$ Ω·cm.

The brush fibers 2*b* forming the brush preferably have a thickness from 1 denier to 10 deniers.

The filling density of the brush fibers 2*b* is preferably in a range from 120 pcs(pieces or fibers)/mm$^2$ to 10000 pcs/mm$^2$. If the filling density is excessively low, the brush cannot ensure a sufficient contact area on the photosensitive member 1, resulting in faulty charging. It is difficult or impossible to produce the brush having the filling density exceeding 10000 pcs/mm$^2$. It is further preferable that the brush has the fiber filling density from 155 pcs/mm$^2$ to 10000 pcs/mm$^2$.

<Auxiliary Charging Particle>

Each of the auxiliary charging particle 3 has an acicular (needle-shaped) form.

The auxiliary charging particles 3 may be made of metal oxide such as zinc oxide, tin oxide, titanium oxide, iron oxide, aluminum oxide or magnesium oxide, or carbon particles made of, e.g., carbon black, graphite, fullerene or carbon nanotube.

When using the metal oxide, it may contain metal element(s) other than the primary metal element(s). For example, zinc oxide containing aluminum, or tin oxide containing antimony may be used. Also, the particles 3 may be formed of a core material, which is made of titanium oxide, aluminum borate, barium sulfate or the like, and is coated with tin oxide containing antimony.

For example, acicular particles of titanium oxide coated with electrically conductive tin oxide can be produced in a method proposed, e.g., in Japanese Laid-Open Patent Publication No. H9-175821. In this method, a reaction product obtained by processing hydrous titanium oxide with alkali is instantaneously mixed and reacted with hydrochloric acid, and then is heated and aged at a temperature not exceeding 80° C. Thereafter, a product thus prepared is mixed and reacted with hydrochloric acid, and then is heated and aged at a temperature not lower than 85° C. so that an acicular titanium oxide is obtained. Water-soluble tin compound and water-soluble antimony compound are added to this titanium oxide so that the surface of the titanium oxide is coated with hydrous tin oxide and hydrous antimony oxide. Then, the product is baked to produce the acicular auxiliary charging particles each coated with a conductive layer of the tin oxide containing antimony.

For examples, FS-10P manufactured by Ishihara Techno Corp. is commercially available as the electrically conductive tin oxide. FT-1000 and FT-2000 manufactured by Ishihara Techno Corp. are commercially available as the titanium oxide coated with the conductive tin oxide. PASTRAN 5110A and 5110Y manufactured by Mitsui Mining & Smelting Co., Ltd. are commercially available as the barium sulfate coated with conductive tin oxide.

In any of the cases employing the above materials, the acicular auxiliary charging particles 3 can be in contact with the brush fibers through a wider area than spherical particles. Therefore, a large Van der Waals force and a large liquid cross-link force act between the auxiliary charging particles 3 and the brush fibers so that it is possible to increase the adhesion force of the auxiliary charging particles 3 with respect to the brush fibers.

In particular, an aspect ratio of the auxiliary charging particle 3 can be set to two or more, whereby the contact area between the particles and the brush fibers can be further increased, as compared with the spherical particles. Thereby, the large Van der Waals force and the large liquid cross-link force act between the auxiliary charging particles 3 and the brush fibers so that it is possible to increase the adhesion force between the auxiliary charging particles 3 and the brush fibers.

The aspect ratio of the particle is a ratio (L/D) between a length L (μm) along a long axis of the particle and a length D (μm) along a short axis of the particle. These lengths L and D of the auxiliary charging particle can be determined by a conventional particle diameter measuring method utilizing laser diffraction, light scattering, electron-microscope measuring or the like. In particular, laser diffraction is preferable.

In a specific example, the following manner was employed. Five cubic centimeters (5 cc) of pure water and a small amount of surface active agent were added to 10 mg of auxiliary charging particles, and processing by a supersonic vibrator was performed for five minutes to disperse the conductive particles.

Then, measurement was performed with a particle size distribution meter (Mastersizer 2000 manufactured by Malvern Instruments Ltd.). Particle size distribution of two components formed of a peak corresponding to a short axis and a peak corresponding to a long axis was obtained. A volume-average particle diameter of the peak on the short axis side was used as the value D, and the volume-average particle diameter of the peak on the long axis side was used as the value L.

The upper limit of the aspect ratio is equal to about 10000. It is difficult to manufacture the auxiliary charging particles of the aspect ratio exceeding 10000.

The aspect ratio of the auxiliary charging particles is preferably in a range from 3 to 10000, more preferably in a range from 5 to 10000, and further preferably in a range from 10 to 200.

It is preferable that the acicular auxiliary charging particle 3 has the long axis of the length L (μm) satisfying a relationship of ($L^2/T \leqq 200$) where T represents a size (denier) of one brush fiber.

If $L^2/T$ is excessively large, the following disadvantage occurs.

The surface of the brush fiber is not flat, but is curved, and $L^2/T$ substantially corresponds to a ratio of the long-axis length L of the auxiliary charging particle 3 with respect to a curvature of the brush fiber surface. Therefore, an excessively large value of $L^2/T$ represents that the length L of the auxiliary charging particle is excessively long with respect to the curvature of the surface of the brush fiber. If the long-axis length L of the auxiliary charging particle is excessively large, this increases a rate of a portion of the auxiliary charging particle, which is not in contact with the brush fiber when the long axis of the brush fiber is not parallel to the long axis of the auxiliary charging particle, and thereby decreases a rate of the contact area between the particle 3 and the brush fiber with respect to the whole surface area of the auxiliary charging particle 3. Therefore, it is impossible to achieve a sufficient adhesion force between the particle 3 and the brush fiber so that the stable charging cannot be performed.

Accordingly, it is preferable to satisfy the relationship of ($L^2/T \leqq 200$). If satisfied, the ratio of the area of contact between the particle and the brush fiber with respect to the whole surface area of the auxiliary charging particle 3 can be large even when the long axis of the brush fiber is not parallel to the long axis of the auxiliary charging particle 3. Therefore, the Van der Waals force and the liquid cross-link force can provide a large adhesion force between the auxiliary charging particles 3 and the brush fibers.

The value of $L^2/T$ is preferably equal to or lower than 120, and is more preferably equal to or lower than 50.

The value of T is preferably in a range from 1 to 10. Since it is difficult to produce the particles having the size L smaller than 0.1, the value of $L^2/T$ is preferably equal to or larger than 0.001.

The volume average particle diameter of the auxiliary charging particles 3 is preferably in a range from 0.05 μm to 10 μm. If the volume average particle diameter of the auxiliary charging particles 3 is excessively small, this increases the manufacturing cost of the auxiliary charging particles and thus the cost of the charger. If auxiliary charging particles 3 of an excessively large volume average particle diameter is used on a roller-type brush, a large centrifugal force is applied to the auxiliary charging particles 3 in accordance with the rotation of the brush so that the amount of the particles 3 removed from the brush increases. Therefore, it is difficult to perform stable charging for a long term.

It is further preferable that the volume average particle diameter of the auxiliary charging particles 3 is in a range from 0.1 μm to 5 μm.

It is preferable that the auxiliary charging particles 3 have a volume resistivity (specific volume resistance) not exceeding $1\times10^{10}$ Ω·cm. If it has a volume resistivity exceeding $1\times10^{10}$ Ω·cm, it is impossible to supply sufficient charges from the brush to the charging target (i.e., photosensitive member 1), resulting in irregular charging.

It is further preferable that the auxiliary charging particles 3 have a volume resistivity not exceeding $1\times10^{8}$ Ω·cm. If it has an excessively small volume resistivity, the particles adhered onto the surface of the photosensitive member cause image flow. Therefore, the volume resistivity is preferably not lower than $1\times10^{-4}$ Ω·cm, and is further preferably not lower than $1\times10^{1}$ Ω·cm.

<Adhesion of Auxiliary Charging Particles>

The auxiliary charging particles 3 can be adhered onto the brush 21, e.g., by distributing an appropriate amount of auxiliary charging particles 3 over a flat plate, and rotating the brush 21 in contact with the plate to apply the auxiliary charging particles 3 onto the brush 21. By changing an amount of the auxiliary charging particles 3 distributed over the flat plate, it is possible to control the amount of the particles 3 adhered onto the brush 21.

It is preferable that the auxiliary charging particles 3 exhibit an average adhesion amount from 0.3 mg/cm$^3$ to 30 mg/cm$^3$ in a space filled with the brush fibers of the charging brush. If the adhesion amount of the auxiliary charging particles 3 is excessively small, insufficient contact occurs between the brush 21 and the photosensitive member 1 via the auxiliary charging particles 3, resulting in faulty charging. Also, the auxiliary charging particles 3 are removed from the brush so that long-term stability cannot be achieved.

Conversely, if the average adhesion amount is excessively large, the auxiliary charging particles 3 in a condensed or gathered form move from the brush onto the photosensitive member 1, and thus cause image noises. Further, the auxiliary charging particles 3 dispersed from the brush 21 may smear surroundings.

It is more preferable that the auxiliary charging particles 3 exhibit an average adhesion amount from 0.6 mg/cm$^3$ to 20 mg/cm$^3$ in a space filled with the brush fibers of the brush.

In addition to portions of the brush fibers to be in contact with the charging target (i.e., photosensitive member 1), the auxiliary charging particles 3 may be adhered to base portions of the brush fibers so that the auxiliary charging particles 3 adhered onto the base portions can be supplied to the charging nip portion so as to compensate for removal or loss of the auxiliary charging particles 3.

When rotating the brush roller 21, a weak centrifugal force acts on the auxiliary charging particles 3 adhering to the base portions, and thereby gradually moves the auxiliary charging particles 3 toward the distal end of the brush so that the auxiliary charging particles 3 are supplied to the charging nip portion.

Since the brush 21 has a function of charging the charging target as well as a function of supplying the auxiliary charging particles 3 by itself, the stable charging can be performed for a further long term by the simple structure.

As already described, the fur brush may be selected from the two types, i.e., the straight hair type and the inclined hair type. From the viewpoint of holding and supplying the auxiliary charging particles 3, the inclined hair type is more advantageous.

In the inclined hair type, the auxiliary charging particles 3 on the base portions of the brush fibers of the fur brush roller are covered with the outer inclined fibers of the fur brush roller so that excessive movement to the charging nip portion and excessive dispersion by the centrifugal force are prevented. As compared with the straight hair type, the fibers of the brush of inclined hair type change their forms to a smaller extent immediately after the fibers passed the nip portion. Therefore, it is possible to suppress dispersion of the auxiliary charging particles 3 due to this changing of the form. For these reasons, the inclined hair brush can supply the auxiliary charging particles 3 to the charging nip portion more stably.

Auxiliary charging particle supply means other than the above may be employed. For example, the auxiliary charging particles 3 may be mixed into developer, and the developer thus prepared may be adhered onto the photosensitive member 1 for moving it to the charging nip portion. Alternatively, a supply member such as a roller, fur brush, blade or the like may be used for supplying the auxiliary charging particles 3. Addition of such supply means allows stable charging for a further long term.

<Charging>

The fur brush 21 carrying the auxiliary charging particles 3 is kept in contact with the photosensitive member 1 while keeping a predetermined push-in amount, and the photosensitive member 1 is charged by applying a DC bias from the power source PW to the fur brush 21 in a rotating state. Thereby, the photosensitive member 1 can be uniformly charged to attain the charged potential substantially equal to the applied voltage. For example, even after a thousand sheets are printed, a good charged state can be obtained.

An alternating (AC) voltage may be superimposed on the DC bias. For example, a square wave of a peek-to-peek voltage of 500 V and a frequency of 1 kHz may be superimposed on the DC bias of −600 V.

<Rotation of Fur Brush>

When the surface of the fur brush 21 moves counter to the moving direction of the surface of the photosensitive member 1, an absolute value |θ| of relative speed ratio (relative peripheral speed ratio) of the fur brush 21 with respect to the photosensitive member 1 preferably satisfies a relationship of ($1 \leqq |\theta| < 5$).

If |θ| is excessively small, the fur brush 21 cannot achieve a sufficient contact amount with respect to the photosensitive member 1, resulting in faulty charging. If |θ| is excessively large, the fur brush 21 slides on the photosensitive member 1 to a higher extent, and thereby may damage the surface of the photosensitive member 1 so that irregular charging is liable to occur. Also, the photosensitive member 1 and the fur brush 21 are shaved to a larger extent, which reduces the durability thereof. Further, a large centrifugal force acts on the auxiliary charging particles 3 on the fur brush 21. This increases an amount of the particles removed from the fur brush 21 so that stable charging for a long term is impossible.

It is further preferable in the above counter rotation operation that the absolute value |θ| of relative speed ratio of the fur brush 21 with respect to the photosensitive member 1 satisfies a relationship of ($1.5 \leqq |\theta| < 4$).

The surface of the fur brush 21 may move together with the surface of the photosensitive member 1. In this case, it is preferable that the absolute value |θ| of relative speed ratio of the fur brush 21 with respect to the photosensitive member 1 satisfies a relationship of ($1.5 \leqq |\theta| < 5$).

For achieving the speed ratio equal to that in the counter-rotation operation, the rotation speed must be increased. As the rotation speed increases, the fur brush 21 slides on the photosensitive member 1 to a higher extent so that the fur brush 21 is more liable to damage the surface of the photosensitive member 1, and therefore the irregular charging is liable to occur. Further, the photosensitive member 1 and the fur brush 21 are shaved to a higher extent, which reduces the durability thereof. Further, a large centrifugal force acts on the auxiliary charging particles 3 on the fur brush 21, and thereby increases the amount of particles removed from the fur brush 21 so that the stable charging for a long term becomes impossible. In view of the above, it is advantageous that the fur brush 21 rotates counter to the surface of the photosensitive member 1.

In the above with-rotation operation, it is further preferable that the absolute value |θ| of speed ratio of the fur brush 21 with respect to the photosensitive member 1 satisfies a relationship of ($2 \leqq |\theta| < 4$).

<Push-in Amount of Fur Brush>

It is preferable that the push-in amount of the fur brush 21 with respect to the photosensitive member 1 is in a range from 0.1 mm to 2 mm. If the push-in amount is excessively small, it is impossible to achieve a sufficiently stable contact amount (contact nip) between the fur brush 21 and the photosensitive member 1, and the pushing force becomes small so that it is impossible to reduce sufficiently a contact resistance (electric resistance) of the brush fibers and the auxiliary charging particles 3 with respect to the photosensitive member 1. This results in irregular charging due to insufficient charging.

If the push-in amount is excessively large, the fur brush 21 applies an excessively large pushing force to the photosensitive member 1 so that a large frictional force occurs. Thereby, damages of the surface of the photosensitive member 1 and thus the irregular charging are liable to occur, and the amount of wearing of the photosensitive member 1 and the fur brush 21 increase so that the durability thereof becomes short. Further, the brush fibers are deformed to a larger extent. This may cause the following situation. After the fibers passes through the charging nip portion, the brush fibers are spaced from the photosensitive member 1 and return to the initial form. In this returning operation, a large force acts on the auxiliary charging particles 3 on the brush fibers to remove them from the fibers so that a large amount of auxiliary charging particles 3 are removed from the brush fibers. Therefore, stable charging for a long term cannot be achieved.

The push-in amount of the fur brush 21 with respect to the photosensitive member 1 is preferably in a range from 0.2 mm to 1.0 mm, and is more preferably in a range from 0.3 mm to 0.8 mm.

EXPERIMENTAL EXAMPLES

Experimental examples, in which the contact chargers according to the embodiments of the invention were used for image formation, as well as a comparative example will now be described. In the following experimental examples and comparative example, printing was performed with a commercially available printer (magicolor 2200 DeskLaser manufactured by Minolta-QMS Ltd.), in which a charger was replaced with one of the following contact chargers, and charts of a B/W ratio of 5% were printed.

Evaluation was effected on the contact chargers having the fur brush 21 of the structure shown in FIGS. 2 and 3.

The brush fibers 2*b* were made of conductive nylon UUN (manufactured by Unitika Ltd.) formed of nylon 6 and carbon black dispersed therein. Each brush fiber has a thickness of 2 deniers, and the brush fiber filling density in the brush is 524 pcs/mm$^2$. The brush fiber has a volume resistivty of $3.6 \times 10^4$ Ω·cm.

The volume resistivity of the brush fibers was determined by obtaining a resistance value (filament resistance) from a bundle of fibers of 1.5 cm in length, and converting it.

The brush fibers 2*b* were set on a base fabric, and the base fabric thus formed was wound around the core roller 20 of 6 mm in diameter, and was fixed thereto by double-face adhesive tape to provide a roller form, in which the base fabric and the double-face adhesive tape had a total thickness of 0.5 mm. The roller thus produced was subjected to a hair-inclining step for inclining the brush fibers so that the hair-inclined brush roller was produced. The inclining direction of the fibers was determined such that the fibers of the fur brush 21 project from the base fabric upstream in the rotation direction of the fur brush 21 (forwardly in the moving direction of the photosensitive member surface) when the surface of the fur brush 21 moves counter to the surface of the photosensitive member 1.

The fur brush 21 had an outer diameter of 13.8 mm before inclining the fibers, and had an outer diameter of 12.2 mm after inclining the fibers. This fiber-inclination reduced the size of the brush fibers by 21% in the radial direction of the brush.

The photosensitive member of the foregoing printer had an outer diameter of 30 mm, and was rotated at 100 rpm (system speed of 160 mm/sec) in the experiments. The fur brush 21 carrying the auxiliary charging particles 3 was in contact with the photosensitive member with the push-in amount of 0.4 mm, and the fur brush 21 was rotated at 480 rpm to move counter to the surface of the photosensitive member.

The absolute value |θ| of speed ratio of the fur brush 21 with respect to the photosensitive member was equal to 2. The fur brush 21 was supplied with a DC bias of −600 V for charging the photosensitive member.

Experimental Example 1

The auxiliary charging particles 3 used in this example were primarily made of titanium oxide, and were coated with electrically conductive tin oxide containing antimony. The particle 3 had an acicular form, an aspect ratio of 13 and a volume resistivity of $1\times10^1$ Ω·cm. The length L (μm) of the long axis of the particle and the thickness of T (deniers) of each fiber of the fur brush satisfied a relationship of ($L^2/T=1.4$). The average adhesion amount of the auxiliary charging particles 3 in the space filled with the brush fibers of the fur brush 21 was 6 mg/cm$^3$.

The volume resistivity of the auxiliary charging particles was determined in such a manner that about 1 gram of particles was put into a plastic cylinder or tube of 10 mm in diameter, and a pressure of 100 kg/cm$^2$ was applied to the particles by a hydraulic jack to produce a specimen. The volume resistivity was determined from the thickness of the specimen and a value of current measured when a voltage of 1 V is applied thereto. This manner was employed also in other experimental examples and the comparative example.

Experimental Example 2

The auxiliary charging particles 3 used in this example were made of tin oxide containing antimony. The particle 3 had an acicular form, an aspect ratio of 107 and a volume resistivity of $1\times10^2$ Ω·cm. The length L (μm) of the long axis of the particle and the thickness of T (deniers) of each fiber of the fur brush satisfied a relationship of ($L^2/T=1.3$). The average adhesion amount of the auxiliary charging particles 3 in the space filled with the brush fibers of the fur brush 21 was 4 mg/cm$^3$.

Experimental Example 3

The auxiliary charging particles 3 used in this example were primarily made of titanium oxide, and were coated with electrically conductive tin oxide containing antimony. The particle 3 had an acicular form, an aspect ratio of 14 and a volume resistivity of $1\times10^1$ Ω·cm. The length L (μm) of the long axis of the particle and the thickness of T (deniers) of each fiber of the fur brush satisfied a relationship of ($L^2/T=4.1$). The average adhesion amount of the auxiliary charging particles 3 in the space filled with the brush fibers of the fur brush 21 was 7 mg/cm$^3$.

Experimental Example 4

The auxiliary charging particles 3 used in this example were primarily made of barium sulfate, and were coated with electrically conductive tin oxide containing antimony. The particle 3 had an acicular form, an aspect ratio of 15 and a volume resistivity of $1\times10^1$ Ω·cm. The length L (μm) of the long axis of the particle and the thickness of T (deniers) of each fiber of the fur brush satisfied a relationship of ($L^2/T=113$). The average adhesion amount of the auxiliary charging particles 3 in the space filled with the brush fibers of the fur brush 21 was 6 mg/cm$^3$.

Experimental Example 5

The auxiliary charging particles 3 used in this example were made of carbon nanotube. The particle 3 had an acicular form and an aspect ratio of 4615. The length L (μm) of the long axis of the particle and the thickness of T (deniers) of each fiber of the fur brush satisfied a relationship of ($L^2/T=18$). The average adhesion amount of the auxiliary charging particles 3 in the space filled with the brush fibers of the fur brush 21 was 4 mg/cm$^3$.

Experimental Example 6

The auxiliary charging particles 3 used in this example were primarily made of barium sulfate, and were coated with electrically conductive tin oxide containing antimony. The particle 3 had an acicular form, an aspect ratio of 20 and a volume resistivity of $1\times10^1$ Ω·cm. The length L (μm) of the long axis of the particle and the thickness of T (deniers) of each fiber of the fur brush satisfied a relationship of ($L^2/T=200$). The average adhesion amount of the auxiliary charging particles 3 in the space filled with the brush fibers of the fur brush 21 was 7 mg/cm$^3$.

Comparative Example 1

The auxiliary charging particles 3 used in this example were primarily made of barium sulfate, and were coated with electrically conductive tin oxide containing antimony. The particle 3 had a spherical form, an aspect ratio of 1 and a volume resistivity of $1\times10^2$ Ω·cm. The length L (μm) of the long axis of the particle and the thickness of T (deniers) of each fiber of the fur brush satisfied a relationship of $L^2/T=0.005$. The average adhesion amount of the auxiliary charging particles 3 in the space filled with the brush fibers of the fur brush 21 was 3 mg/cm$^3$.

In the experimental examples and comparative example described above, the charging property was evaluated as follows. The irregularities in charged potential on the surface of the photosensitive drum were measured when starting operation of a new brush roller charger and after printing of one thousand charts of a B/W ratio of 5%. Based on the results of such measurement, the charging property was evaluated.

The surface potential was measured with a surface potentiometer MODEL 344, probe 6000B-16 manufactured by Trek Japan corp. In the measuring operation, the developing device was removed, the probe was arranged and a DC bias of −600 V was applied to the fur brush to charge the surface of the photosensitive drum. The potential of the surface of the photosensitive drum thus charged was measured for a predetermined time without performing exposure. A difference between maximum and minimum values of the surface potential measured during the above period was determined as a charged potential irregularity |V|.

In the following table, the charging property was evaluated based on the following criterion.

(Evaluation Criterion of Charging Property)

Good: $|\Delta V|<20$ V

Allowed: $20\ V\leqq|\Delta V|<50$ V

Faulty: $50\ V\leqq|\Delta V|$

TABLE

| | Form* | Ratio* | $L^2/T$ | 0- \|ΔV\|* | 1000- \|ΔV\|* |
|---|---|---|---|---|---|
| EX*1 | needle | 13 | 1.4 | good | good |
| EX*2 | needle | 107 | 1.3 | good | good |
| EX*3 | needle | 14 | 4.1 | good | good |
| EX*4 | needle | 15 | 113 | good | allowed |
| EX*5 | needle | 4615 | 18 | good | good |
| EX*6 | needle | 20 | 200 | good | allowed |
| CX*1 | sphere | 1 | 0.005 | allowed | faulty |

Form*: particle form
Ratio*: aspect ratio
0- |ΔV|*: |ΔV| before printing
1000- |ΔV|*: |ΔV| after 1000 printing
EX* Experimental Example
CE* Comparative Example As described above, the contact charger, which charges the charging target with the auxiliary charging particles interposed between the charging brush and the charging target, employs the auxiliary charging particles each having an acicular form so that the auxiliary charging particles can be in contact with the brush fibers through a wider contact area than spherical particles. Thereby, the large Van der Waals force and the large liquid cross-link force act between the auxiliary charging particles and the brush fibers so that it is possible to increase the adhesion force of the auxiliary charging particles with respect to the brush fibers. Thereby, uniform and stable charging can be easily achieved for a long term.

Since the auxiliary charging particle has the acicular form and the predetermined aspect ratio, a large contact area can be ensured between the auxiliary charging particles and the brush fibers. This likewise increases the Van der Waals force and the large liquid cross-link force acting between the auxiliary charging particles and the brush fibers so that it is possible to increase the adhesion force of the auxiliary charging particles with respect to the brush fibers. Thereby, uniform and stable charging can be easily achieved for a long term.

The auxiliary charging particle has an acicular form, and the length L (μm) of the long axis of the particle and the thickness of T (deniers) of each brush fiber satisfy the predetermined relationship. Thereby, even when the long axis of the brush fiber is not parallel to the long axis of the auxiliary charging particle, it is possible to provide a sufficient adhesion force between the auxiliary charging particles and the brush fibers. Thereby, uniform and stable charging can be easily achieved for a long term.

Owing to the above features, it is possible to provide the inexpensive charger, which operates with a low voltage and without generating ozone, as well as a novel and useful image forming apparatus utilizing the charger.

The charger can be used in a so-called cleanerless system, which does not use a cleaning blade to be in contact with the charging target. The cleanerless system can be configured to control the charges of untransferred residual toner on an image carrying member such as a photosensitive drum, and thereby can reuse the residual toner without using the cleaning blade.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A contact charger comprising a charging brush having brush fibers for charging, and auxiliary charging particles having acicular forms wherein said auxiliary charging particles exhibit an average adhesion amount from 0.3 mg/cm$^3$ to 20 mg/cm$^3$ in a space filled with said brush fibers.

2. The contact charger according to claim 1, wherein an aspect ratio of said auxiliary charging particles is in a range from 2 to 10000.

3. The contact charger according to claim 1, wherein an aspect ratio of said auxiliary charging particles is in a range from 10 to 200.

4. The contact charger according to claim 1, wherein a length L (μm) of a long axis of said auxiliary charging particle and a thickness of T (deniers) of each of said fibers of said charging brush satisfy a relationship of $L^2/T \leqq 200$.

5. The contact charger according to claim 4, wherein the length L (μm) of the long axis of said auxiliary charging particle and the thickness of T (deniers) of each of said fibers of said charging brush satisfy a relationship of $L^2/T \leqq 50$.

6. The contact charger according to claim 4, wherein the length L (μm) of the long axis of said auxiliary charging particle and the thickness of T (deniers) of each of said fibers of said charging brush satisfy a relationship of $L^2/T \geqq 0.001$.

7. The contact charger according to claim 1, wherein a primary particle diameter of said auxiliary charging particles is in a range from 0.05 μm to 10 μm.

8. The contact charger according to claim 1, wherein a primary particle diameter of said auxiliary charging particles is in a range from 0.1 μm to 5 μm.

9. The contact charger according claim 1, wherein said auxiliary charging particles have a volume resistivity not exceeding $1\times10^{10}$ Ω·cm.

10. The contact charger according claim 9, wherein said auxiliary charging particles have a volume resistivity from $1\times10^{-4}$ Ω·cm to $1\times10^{10}$ Ω·cm.

11. The contact charger according to claim 1, wherein the brush fibers of said charging brush have a thickness from 1 denier to 10 deniers.

12. The contact charger according to claim 1, wherein a filling density of brush fibers of said charging brush is in a range from 120 pcs/mm$^2$ to 10000 pcs/mm$^2$.

13. The contact charger according claim 1, wherein the brush fibers of said charging brush have a volume resistivity from $1\times10^{1}$ Ω·cm to $1\times10^{8}$ Ω·cm.

14. The contact charger according to claim 1, wherein said charging brush has a roller form, and the brush fibers of the brush roller were subjected to a hair-inclining processing to incline the brush fibers toward upstream in a rotating direction of the brush roller.

15. An image forming apparatus for forming an image in an electrophotographic manner, comprising:

a contact charger including a charging brush having brush fibers for charging, and auxiliary charging particles having acicular forms;

a photosensitive member to be charged by said contact charger;

an exposing device performing image exposure on said photosensitive member to form an electrostatic latent image; and a developing device developing the electrostatic latent image on said photosensitive members;

wherein said auxiliary charging particles exhibit an average adhesion amount from 0.3 $mg/cm^3$ to 20 $mg/cm^3$ in a space filled with said brush fibers.

16. The image forming apparatus according to claim 15, wherein said charging brush has a roller form, and is arranged to be driven to rotate in such manner that a surface of the brush roller moves counter to a moving direction of a surface of the photosensitive member with an absolute value $|\Theta|$ of relative peripheral speed ratio of the brush roller with respect to the photosensitive member satisfying a relationship of $(1 \leqq |\Theta| < 5)$.

17. The image forming apparatus according to claim 15, wherein said charging brush has a roller form, and is arranged to be driven to rotate in such manner that a surface of the brush roller moves together with a surface of the photosensitive member with an absolute value $|\Theta|$ of relative peripheral speed ratio of the brush roller with respect to the photosensitive member satisfying a relationship of$(1.5 \leqq |\Theta| < 5)$.

18. The image forming apparatus according to claim 15, wherein a push-in amount of the charging brush of said contact charger with respect to the photosensitive member is in a range from 0.1 mm to 2.0 mm.

19. The image forming apparatus according to claim 15, wherein said charging brush has a roller form, and the brush fibers of the brush roller were subjected to a hair-inclining processing to incline the brush fibers toward upstream in a rotating direction of the brush roller.

* * * * *